US005471772A

United States Patent [19]

Blaszynski et al.

[11] Patent Number: 5,471,772

[45] Date of Patent: Dec. 5, 1995

[54] FAIRLEAD MECHANISM WITH SYNCHRONIZED SHEAVES

[75] Inventors: Robert H. Blaszynski, Waukesha; Carl A. Soczka, Greenfield, both of Wis.

[73] Assignee: Harnischfeger Corporation, Brookfield, Wis.

[21] Appl. No.: 86,154

[22] Filed: Jul. 1, 1993

[51] Int. Cl.[6] ..... E02F 3/58

[52] U.S. Cl. ..... 37/397; 294/82.11

[58] Field of Search ..... 37/394, 395, 396, 37/397; 294/82.11, 82.15; 254/395, 396, 397

[56] References Cited

U.S. PATENT DOCUMENTS

| | | | |
|---|---|---|---|
| 16,992 | 4/1857 | Osgood | 254/395 |
| 141,551 | 8/1873 | Farrell . | |
| 258,913 | 6/1882 | Hall . | |
| 534,503 | 2/1895 | Fox . | |
| 658,908 | 10/1900 | Fenner | 37/397 X |
| 757,893 | 4/1904 | Daughters . | |
| 832,725 | 10/1906 | Eynon . | |
| 934,809 | 9/1909 | Holmes | 254/397 |
| 948,453 | 2/1910 | Laudon . | |
| 1,767,735 | 6/1930 | Brown | 254/395 X |
| 1,767,737 | 6/1930 | Brown | 37/397 |
| 1,950,288 | 3/1934 | Benson | 254/167 |
| 2,043,362 | 6/1936 | Wilson | 254/397 |
| 2,133,406 | 10/1938 | Shelton et al. | 254/397 X |
| 2,483,760 | 10/1949 | Duncan | 254/190 |
| 2,946,430 | 7/1960 | White et al. | 203/210 |
| 2,947,516 | 8/1960 | Jackson | 254/395 X |
| 3,006,608 | 10/1961 | Cimino | 254/395 |
| 3,070,355 | 12/1962 | Wyatt | 254/396 X |
| 3,641,696 | 2/1972 | Fleischer | 43/24 |
| 3,708,152 | 1/1973 | Bulin | 37/397 X |
| 3,912,230 | 10/1975 | Learmont | 37/397 X |

FOREIGN PATENT DOCUMENTS 1153144 8/1963 Germany .

OTHER PUBLICATIONS

Shigley and Mischke, Mechanical Engineering Design, Fifth Edition ©1989, pp. 665–666, McGraw–Hill Publishing Co.

*Primary Examiner*—Randolph A. Reese
*Assistant Examiner*—Victor Batson
*Attorney, Agent, or Firm*—Michael, Best & Friedrich

[57] ABSTRACT

A fairlead mechanism for guiding a dragline drag rope includes a support on the chassis of the dragline and a guide mechanism mounted on the support. The guide mechanism includes at least one pair of guide sheaves each having an annular groove. The guide sheaves are rotatably mounted on the support to present the grooves in facing relation to define between the sheaves a guide path through which the drag rope passes in primary frictional contact with at least one of the guide sheaves to cause the contacted guide sheave to start-stop cycle between rotating and nonrotating modes as the drag rope reciprocates during operation of the machine. The fairlead mechanism further comprises a synchronizing mechanism utilizing gears or belts for causing the pair of guide sheaves to simultaneously stop or counterrotate in unison in response to rope contact with either one of the guide sheaves to minimize wear that would be induced by scrubbing between the rope and the guide sheaves.

18 Claims, 4 Drawing Sheets

FAIRLEAD MECHANISM WITH SYNCHRONIZED SHEAVES

BACKGROUND OF THE INVENTION

1. Field of the Invention

The present invention relates to a fairlead mechanism for guiding the vertical and horizontal sweeps of movement of a reciprocating rope that is connected to a working tool of an excavating machine such as a dragline or the like.

2. Description of Related Art

A dragline generally comprises a mobile chassis that supports a boom 300 to 400 feet long. The lower end of the boom is pivotally mounted on the chassis to permit the angle of boom elevation to be adjusted. A sheave is rotatably mounted adjacent the top end of the boom. A main lift rope such as a steel wire wound cable has one end connected to a hoist drum on the chassis and its other end reeved over and suspended from the sheave at the top end of the boom. A working tool such as a dragline bucket is connected to the suspended end of the main lift rope and is raised and lowered by actuation of the hoist drum by the dragline operator.

The dragline is pivotable about a vertical axis to provide the boom and the suspended dragline bucket with a working radius which can be 300 feet or more. A dragline bucket drag rope has one end connected to the dragline bucket and its other end connected to a drag rope drum located on the dragline chassis adjacent the foot of the boom. The drag rope drum is selectively energized by the dragline operator to pull the dragline bucket, when it is on the ground, toward the dragline chassis to load the bucket. The drag rope drum is also operative to release the drag rope for travel away from the chassis in order to permit the loaded bucket to be dumped or to permit an empty bucket to be moved to a desired working position remote from the chassis.

During operation the dragline bucket may be raised in order to spoil overburden high on a spoil pile, or to reclaim a spoil pile or the dragline bucket may be lowered down into a mine pit for loading. The lateral swinging movements and the vertical up and down movements of the dragline bucket cause the drag rope to have both a vertical and a horizontal angular sweep of travel relative to the drag rope drum. During the vertical and horizontal sweeping movements the drag rope also reciprocates coward and away from the chassis, and travel of the drag rope after it leaves the drag rope drum must be guided to prevent undesirable contact with the dragline chassis. This guiding of the drag rope is accomplished by what is termed a fairlead mechanism. The drag rope passes through the fairlead mechanism after it leaves the drag rope drum.

The fairlead mechanism includes a pair of grooved horizontal sheaves rotatably mounted side by side on the chassis and a pair of grooved vertical upper and lower sheaves rotatably journaled on a subframe that is pivotally mounted on the chassis for oscillatory movement about a generally vertical axis. The planes in which the horizontal and vertical sheaves lie are arranged at right angles relative to each other. The drag rope upon leaving the drag rope drum first passes between the facing grooves of horizontal sheaves and then between the facing grooves of the vertical sheaves. The drag rope is a wire wound cable which may be up to 4.5 inches in diameter and have a length of 600 to 700 feet in order to permit the dragline bucket to be moved to its various working and dumping positions. The horizontal sheaves can weigh up to 11,200 lbs. each and the vertical sheaves up to 13,300 lbs. each. Usually a dragline will utilize two or more drag ropes and a corresponding number of fairlead mechanisms with all of the drag ropes being connected to a single dragline bucket.

Depending upon the direction of the drag rope sweep, the drag rope will have its primary frictional contact with either one or the other of the horizontal and vertical sheaves and cause the sheaves with which it has its primary frictional contact to rotate at a high rate of speed either clockwise or counterclockwise depending upon the direction of rope travel. When the angular directions of the rope sweeps are altered the primary frictional contact of the rope transfers from one sheave to the other and thus the fairlead sheaves are constantly being start-stop cycled by the changing frictional engagement with the drag rope. For example, assume that the drag rope is in contact with the lower vertical sheave which is being rotated by the drag rope. The upper noncontacted vertical sheave will be stationary. The drag rope is traveling at a high speed (up to 1000 feet per minute) and when the vertical sweep of the drag rope requires it to transfer its primary frictional contact to the upper stationary vertical sheave it will cause the upper sheave to start to rotate in the direction of travel of the drag rope. Due to the inertia of the heavy upper vertical sheave, initially there will be sliding frictional contact called scrubbing between the moving rope and the stationary upper vertical sheave until the rotational velocity of the upper vertical sheave matches the speed and direction of travel of the drag rope.

This scrubbing action creates rope wear and results in drag rope life of 1,000 to 1,500 hours. Draglines are normally operated 24 hours a day and the drag rope can require replacement every two months or less. Replacement of the drag rope is expensive and normally all drag ropes of the dragline are replaced at the same time in order to reduce costs. In order to replace the drag ropes a crawler tractor must be connected to pull each rope from its associated pull drum. Assuming the dragline utilizes two fairleads, two new drag ropes must be provided and connected to the drag rope drums. In addition, labor costs and lost production due to down-time are incurred.

SUMMARY OF THE INVENTION

In order to extend the life of a dragline drag rope, a need exists for an improved, reliable, rugged and low-cost fairlead mechanism that will efficiently and automatically minimize scrubbing between the drag rope and the fairlead sheaves.

The fairlead mechanism of the present invention comprises a support on the chassis of an excavating machine and a guide mechanism mounted on the support. The guide mechanism includes at least one pair of guide sheaves each having an annular groove. The guide sheaves are rotatably mounted on the support to present the grooves in facing relation to define therebetween a guide path through which the drag rope passes in primary frictional contact with at least one of the guide sheaves to cause the one guide sheave to start-stop cycle between rotating and nonrotating modes as the drag rope reciprocates during operation of the excavating machine. The fairlead mechanism further comprises a synchronizing mechanism for causing the pair of guide sheaves to simultaneously stop or counterrotate in unison in response to rope contact with either one of the guide sheaves to minimize wear that would be induced by scrubbing between the rope and the guide sheaves.

The synchronizing mechanism may comprise either a gear mechanism or a belt drive mechanism that interconnects the pair of guide sheaves to cause them to counterrotate in unison in response to rotation of either one of the guide sheaves.

Preferably the fairlead support will include a main frame on the chassis of the excavating machine and a subframe that is mounted on the main frame for oscillatory movement about a generally vertical pivot axis. The guide mechanism may include a pair of first guide sheaves that are rotatably mounted on the main frame to lie in a first generally horizontal plane and a pair of second guide sheaves that are rotatably mounted on the subframe to lie in a second generally vertical plane. The guide path may have a first guide portion between the first guide sheaves and a second guide path portion between the second guide sheaves with the synchronizing mechanism causing the first guide sheaves to counterrotate in unison and causing the second guide sheaves to also counterrotate in unison.

Figure 1:
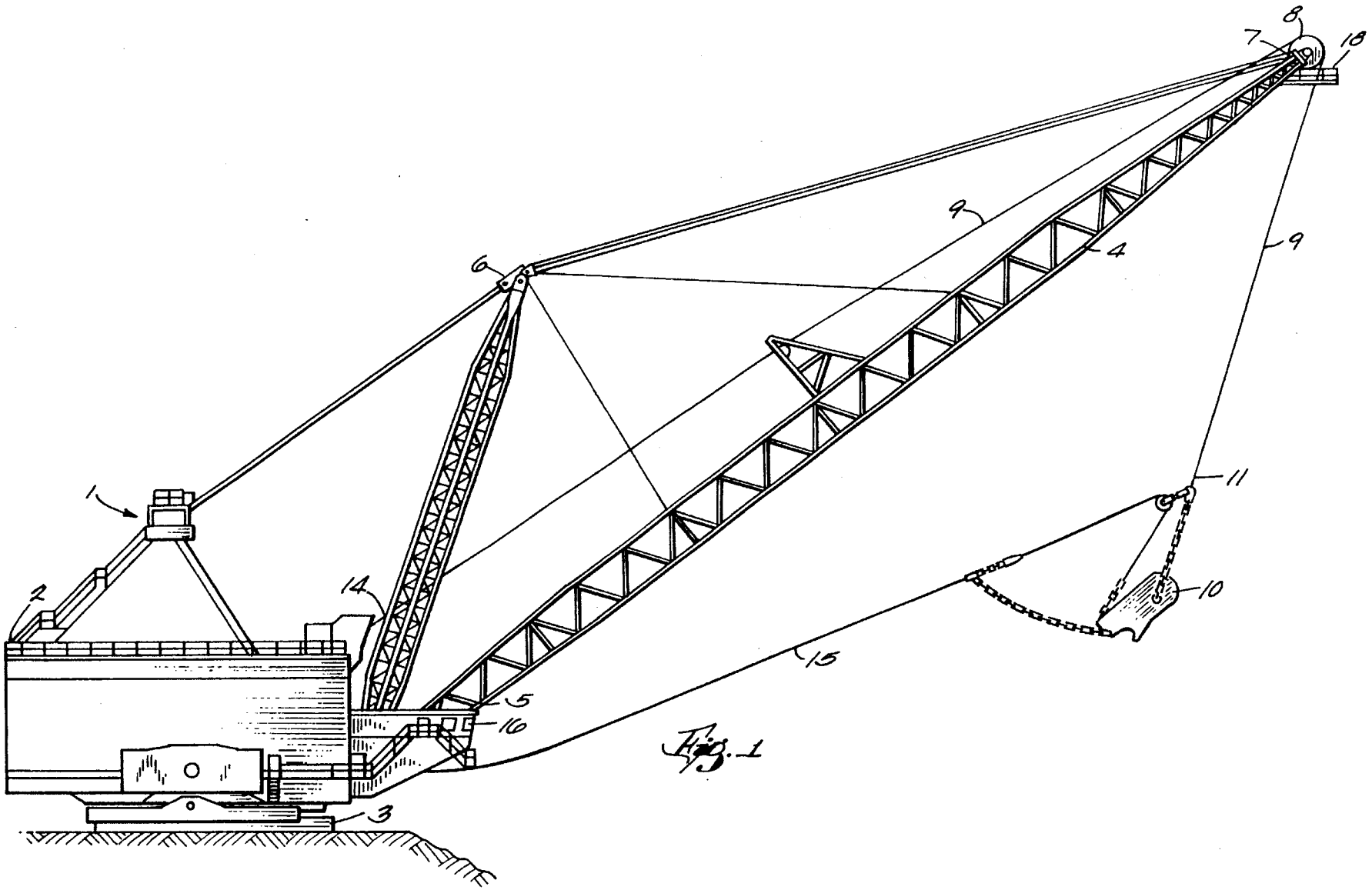
FIG. 1 is a side elevational view of a dragline excavating machine embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENTS

FIG. 1 shows a dragline 1 having a main chassis 2 which has a walking mechanism 3 operable in known manner to move the dragline 1. A boom 4 is mounted at its lower end or foot 5 on the main chassis 2. A mast assembly 6 is provided to support the upper end of the boom 4 and to raise and lower it in known manner. A sheave 8 is rotatably mounted on the upper end 7 of boom 4 and an elongated lifting element such as a wire rope 9 is reeved over sheave 8. A dragline bucket 10 is suspended from one end 11 of rope 9. The other end of rope 9 is connected to a conventional hoist drum (not shown) on the chassis 2. The hoist drum is operated in known manner to raise and lower rope 9 and the bucket 10. The dragline also has a conventional service platform 18 located at the upper end of the boom 4.

One or more drag ropes 15 are connected to the bucket 10. In order to simplify the drawing, FIG. 1 shows a single drag rope 15 connected to the bucket 10, but in actual practice more than one drag rope 15 is frequently required. The drag rope 15 is controlled by the operator to pull the bucket 10 toward the main chassis 2 and to release the drag rope 15 to allow the bucket 10 to move away from the main chassis 2 in the direction of arrows 22, 24 shown in FIG. 2. The dragline 1 includes an operator station 16 at which conventional controls are located to permit the operator to raise and lower the bucket 10 and to move the drag rope 15 toward and away from the chassis in known manner. The dragline 1 as thus far described is conventional and need not be described in further detail.

Referring to FIGS. 2–6, dragline 1 also includes a fairlead mechanism 30 for each drag rope 15. If more than one drag rope 15 and associated fairlead mechanism 30 is used they all will be of identical construction, and therefore only one drag rope 15 and its fairlead mechanism 30 will be described. The fairlead mechanism 30 guides the horizontal and vertical sweeps of the drag rope 15 in the directions indicated by arrows 32, 34 and 36, 38. The fairlead mechanism 30 includes (see FIG. 2) a main support frame 40 which is a portion of the chassis 2. The fairlead mechanism 30 also includes a subframe 42 which is mounted on the main support frame 40 for oscillation about a generally vertical pivot axis 44.

Figure 2:
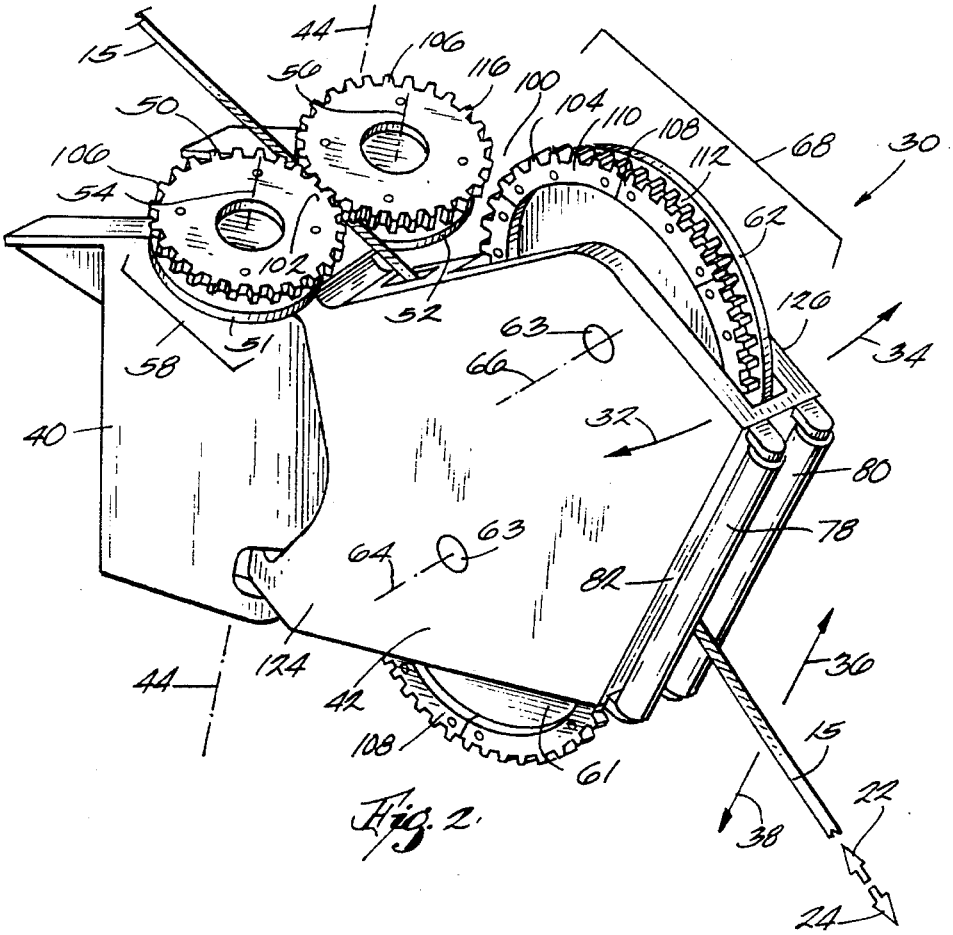
FIG. 2 is an isometric projection view of a fairlead mechanism incorporated in the dragline shown in FIG. 1.
Figure 3:
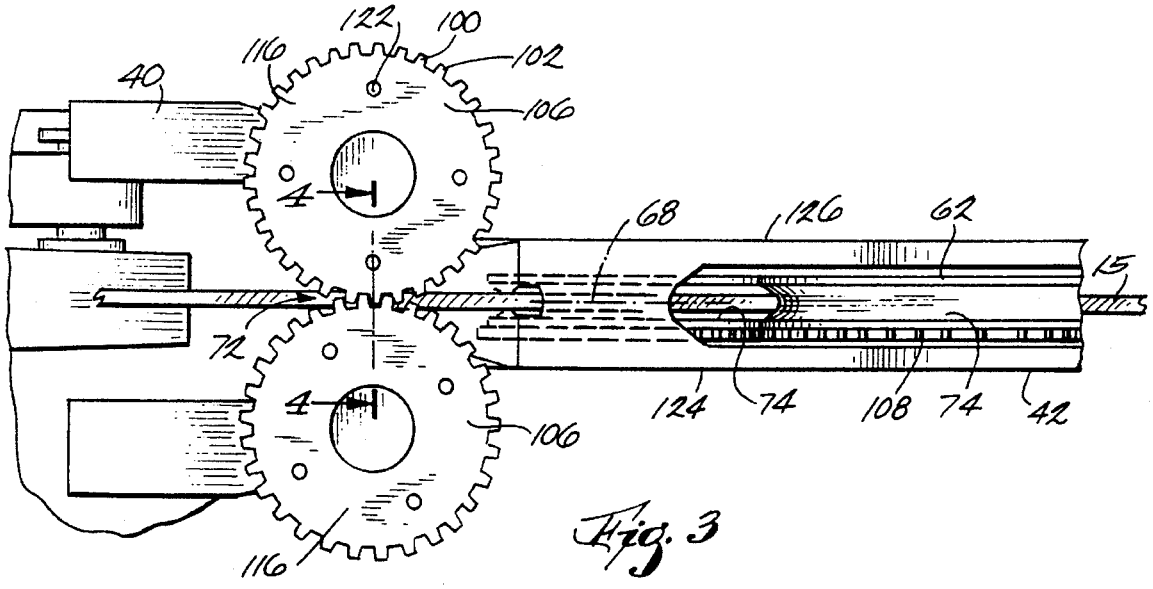
FIG. 3 is a top view of the fairlead mechanism shown in FIG. 2.
Figure 5:
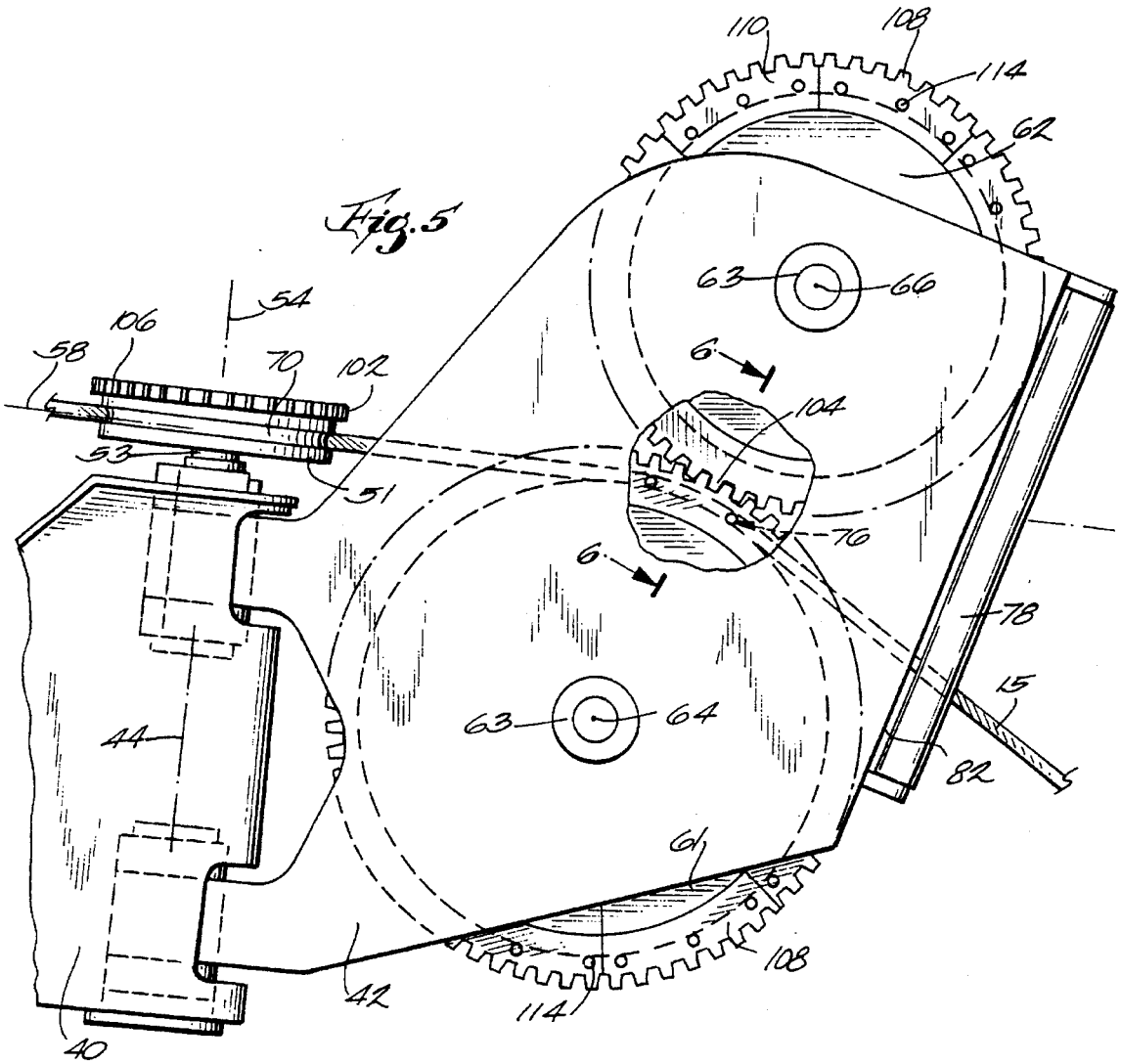
FIG. 5 is a side elevational view of the fairlead mechanism shown in FIG. 2.

The fairlead mechanism 30 further comprises a guide mechanism 50 that includes a pair of first guide sheaves 51 and 52 each mounted on a shaft 53 best shown in FIG. 5. The shafts 53 are journaled on the main support frame 40 for rotation about (see FIG. 2) spaced parallel first axes 54, 56 respectively. The first guide sheaves 51 and 52 lie in a first generally horizontal plane 58 (FIGS. 2 and 5). The guide mechanism 50 also comprises (see FIGS. 2 and 5) a pair of second guide sheaves 61 and 62 each mounted on a shaft 63. The shafts 63 are journaled on the subframe 42 for rotation about spaced parallel axes 64, 66 respectively. The second guide sheaves 61 and 62 lie in a second generally vertical plane 68 (FIGS. 2 and 3). The first and second planes 58, 68 are arranged at right angles relative to each other. The first axes 54, 56 are in spaced parallel relation on opposite sides of the second plane 68 and the second axes 64, 66 lie in spaced parallel relation on opposite sides of first plane 58.

Figure 4:
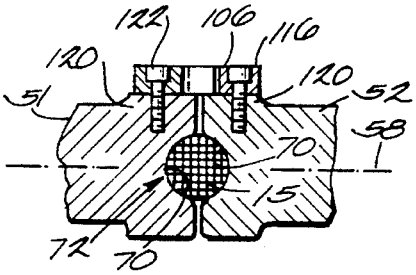
FIG. 4 is a partial sectional view taken along line 4—4 of FIG. 3.

Referring to FIGS. 3–6, the horizontal guide sheaves 51 and 52 each have an annular groove 70 (FIGS. 4 and 5) and the horizontal guide sheaves 51, 52 are rotatably mounted on the main support frame 40 to present the grooves 70 in facing relation as best shown in FIG. 4 to define between the sheaves 51 and 52 a first guide path portion 72 through which the rope 15 passes in primary frictional contact with at least one of the guide sheaves 51 and 52 to cause the contacted horizontal guide sheave to stop-start cycle between rotating and nonrotating modes as the rope 15 reciprocates during operation of the dragline as will be more fully discussed hereinafter.

Figure 6:
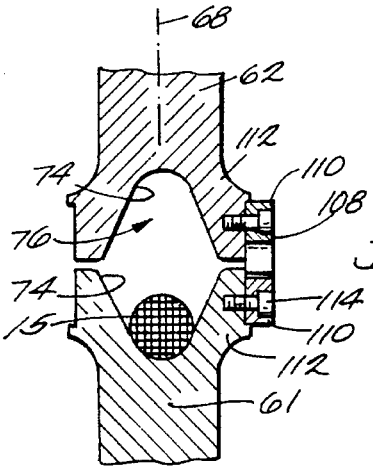
FIG. 6 is a cross-sectional view taken along line 6—6 of FIG. 5.

The vertical guide sheaves 61 and 62 each have (see FIGS. 3 and 6) an annular groove 74 and the vertical guide sheaves 61, 62 are mounted on the main support frame 40 to present the grooves 74 in facing relation as shown on FIG. 6 to define between the sheaves 61, 62 a second guide path portion 76 through which drag rope 15 passes for primary frictional contact with sheave 61 or 62 as the drag rope 15 moves between vertically lower and upper sweep positions.

The fairlead mechanism 30 further includes (see FIGS. 2 and 5) vertical sweep rope guides or rollers 78, 80 rotatably mounted on the subframe 42 in spaced relation at opposite sides of the second vertical plane 68 proximal the outer end 82 of the subframe 42. The space between the vertical sweep rollers 78, 80, the first guide path portion 72 between the horizontal guide sheaves 51, 52 and the vertical guide path portion 76 between the vertical guide sheaves 61, 62 define the guide path for the drag rope 15 through the fairlead mechanism 30. The rollers 78 and 80 have a generally vertical extent which is sufficient to allow for the full vertical sweep of the dragline drag rope 15 throughout its entire range of vertical travel during working of the dragline bucket.

The fairlead mechanism 30 also comprises (see FIG. 2) a synchronizing mechanism 100 for causing the pairs of guide sheaves 51, 52 and 61, 62 to simultaneously stop or to counterrotate in unison in response to primary frictional contact of the drag rope 15 with either one of the guide sheaves in each pair. Referring now to FIGS. 2–6, the synchronizing mechanism 100 comprises a gear mechanism 102 interconnecting the horizontal guide sheaves 51, 52 and a gear mechanism 104 interconnecting the vertical guide sheaves 61, 62 to cause each pair of guide sheaves to counterrotate in unison.

More specifically the gear mechanism 102 comprises (see FIG. 3) a cog wheel 106 on each of the horizontal guide sheaves 51, 52, with the cog wheels 106 being in mesh with each other. The gear mechanism 104 similarly comprises (see FIG. 5) a cog wheel 108 on each of the vertical guide sheaves 61, 62, with the cog wheels 108 being in mesh with each other. Referring to FIGS. 5 and 6, the cog wheels 108 for vertical sheaves 61, 62 are preferably formed by a plurality of arcuate gear segments 110 which are secured to the outer peripheral rim 112 of the sheaves 61 and 62 by means of cap screws 114. Referring to FIG. 4, the cog wheels 106 for the horizontal sheaves 51, 52 are fabricated as complete annular gears rings 116 secured to the outer peripheral rim 120 by cap screws 122. As shown the segments 110 and gear rings 116 are mounted directly on the guide sheave rims but they could be mounted in axially spaced relation to the guide sheaves 51, 52 and 61, 62. As best shown in FIGS. 2 and 3 the sidewalls 124 and 126 of the subframe 42 are spaced apart a distance sufficient to accommodate therebetween the total axial width of the vertical guide sheaves 61 and 62 with the cog wheels 108 mounted thereon. If desired the cog wheels 108 could be mounted on the outside of the side walls 124, 126.

Figure 8:
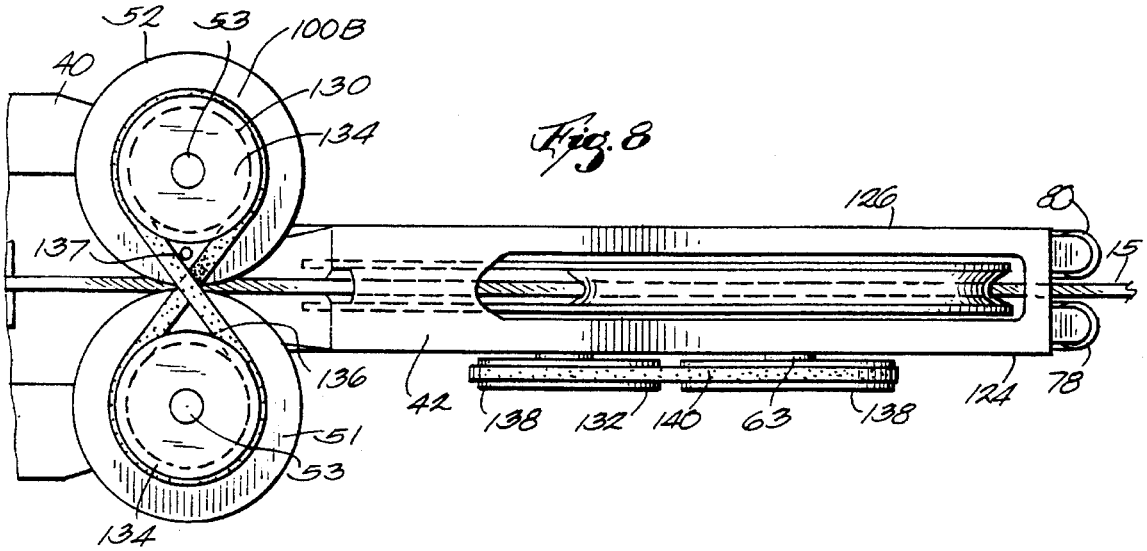
FIG. 8 is a top view of the fairlead mechanism shown in FIG. 7.
Figure 7:
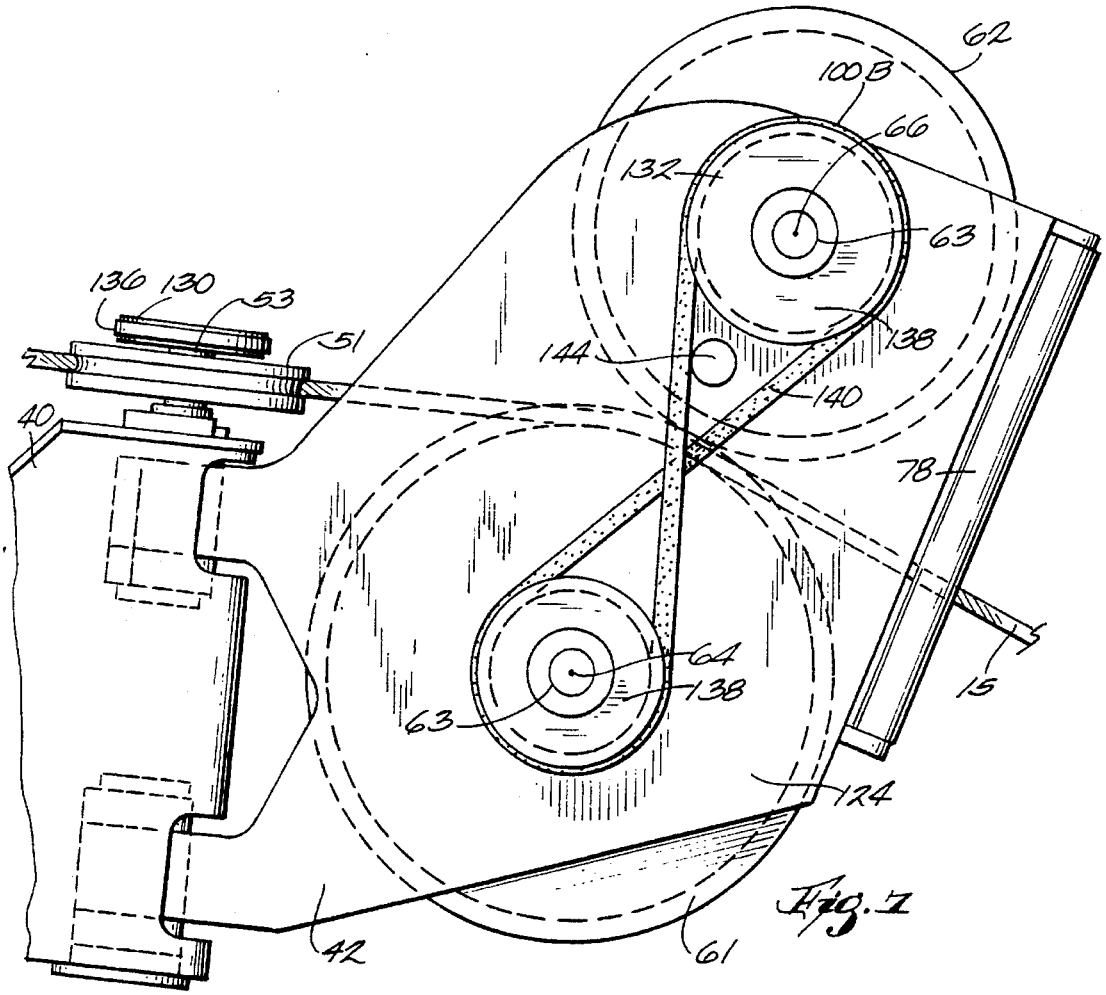
FIG. 7 is a side elevational view of a fairlead mechanism that is a second embodiment of the invention.

A synchronizing mechanism 100B which is a second embodiment of the invention is shown in FIGS. 7 and 8 and utilizes belt drive mechanisms 130 and 132 respectively interconnecting the pairs of first and second guide sheaves 51, 52 and 61, 62. The belt drive mechanism 130 comprises (see FIG. 8) a pulley 134 on each of the shafts 53. A flexible drive element or belt 136 is reeved in a figure-8 configuration about pulleys 134 to cause the horizontal guide sheaves 51, 52 to counterrotate in unison. The belt drive mechanism further includes a spring-biased bell crank belt tensioner 137 which is set to keep the flexible drive element 136 under predetermined proper tension.

The belt drive mechanism 132 for vertical guide sheaves 61, 62 is similar to belt drive mechanism 130. A vertical pulley 138 (see FIG. 7) is mounted on each of the shafts 63, and the pulleys 138 are interconnected by a flexible drive element or belt 140 reeved about the pulleys 138 to counterrotate the guide sheaves 61, 62 in unison. A belt tensioning mechanism 144 similar to belt tensioning mechanism 137 is provided for drive element 140.

As best shown in FIG. 8 the pulleys 138 are mounted externally of the subframe 42 for convenient servicing. If desired the pulleys 140 could be mounted inside of the spaced apart sidewalls 124, 126 of the subframe 42 in a manner similar to that of the cog wheels 108 shown in FIGS. 2 and 3 of the first embodiment.

The belt drive mechanisms 130, 132 shown in FIGS. 7 and 8 both utilize a V-belt as the flexible drive element. However it is to be understood that flat belts or cog belts could be used in place of the V-belts shown.

In operation the dragline drag rope 15 shown in FIG. 2 will be traveling at speeds of up to approximately 1,000 feet per minute back and forth in the directions of arrows 22, 24 as the dragline bucket 10 is moved toward and away from the chassis 2. Simultaneously the dragline bucket 10 will swing laterally from side to side and this lateral movement is transferred by the dragline drag rope 15 to the fairlead subframe 42 causing it to oscillate in the direction of arrows 32, 34 in FIG. 2. When the subframe 42 moves in the direction of arrow 32 the drag rope 15 will be placed in primary frictional engagement with horizontal sheave 51, and when the subframe 42 moves in the direction of arrow 34 the drag rope 15 will be placed in primary frictional engagement with horizontal sheave 52. No matter which of the sheaves 51, 52 is driven by drag rope 15, the synchronizing mechanism 100 will cause the pair of sheaves 51, 52 to simultaneously stop or counterrotate in unison in order to minimize scrubbing and consequent wear between the drag rope 15 and the guide sheaves 51, 52.

In similar manner, during operation the drag rope 15 will be moved up or down in the direction of arrows 36, 38 in FIG. 2, and rope 15 will come into primary frictional engagement with either one or the other of the vertical guide sheaves 61, 62. The synchronizing mechanism 100 will cause the vertical guide sheaves 61, 62 to simultaneously stop or counterrotate in unison in response to contact by drag rope 15 with either one of the guide sheaves 61, 62 to minimize wear caused by scrubbing between the drag rope 15 and the guide sheaves 61, 62.

The fairlead synchronizing mechanisms 100 and 100B are shown by way of example. Equivalent synchronizing mechanisms could be utilized to cause counterrotation of the guide sheaves 51, 52 and 61, 62 in unison in response to contact with the drag rope 15.

Various features of the invention are set forth in the following claims.

We claim:

1. A fairlead mechanism for guiding reciprocating travel of a rope connected to a working tool of an excavating machine such as a dragline, said fairlead mechanism comprising;

a support including a main frame and a subframe mounted on said main frame for oscillatory movement about a generally vertical pivot axis, a guide mechanism including a pair of first guide sheaves rotatably mounted on said main frame and lying in a first generally horizontal plane, and a pair of second guide sheaves rotatably mounted on said subframe and lying in a second generally vertical plane, said guide sheaves each having an annular groove, said guide sheaves of each of said pairs being rotatably mounted on said support to present said grooves in facing relation to define between said sheaves of each of said pairs a guide path portion through which the rope passes in frictional contact with at least one of said guide sheaves of each of said pairs to cause said one guide sheave of each of said pairs to stop-start cycle between rotating and nonrotating modes as the rope reciprocates, a first synchronizing mechanism for causing said pair of first guide sheaves to simultaneously stop or counterrotate in unison in response to rope contact with either one of said first guide sheaves to minimize wear induced by scrubbing between the rope and said first guide sheaves, and a second synchronizing mechanism for causing said pair of second guide sheaves to simultaneously stop or counterrotate in unison in response to rope contact with either one of said second guide sheaves to minimize wear induced by scrubbing between the rope and said second guide sheaves.

2. The fairlead mechanism according to claim 1 wherein at least one of said synchronizing mechanisms comprises a gear mechanism interconnecting said pair of guide sheaves to cause said pair of guide sheaves to counterrotate in unison in response to rotation of either one of said guide sheaves.

3. The fairlead mechanism according to claim 2 wherein said gear mechanism comprises a cog wheel on each of said guide sheaves, said cog wheels being in mesh with each other to counterrotate said guide sheaves in unison.

4. The fairlead mechanism according to claim 1 wherein at least one of said synchronizing mechanisms comprises a belt drive mechanism interconnecting said pair of guide sheaves to cause said pair of guide sheaves to counterrotate in unison in response to rotation of either one of said guide sheaves.

5. The fairlead mechanism according to claim 4 wherein said belt drive mechanism comprises a pulley on each of said guide sheaves, and a flexible drive element reeved around said pulleys to counterrotate said guide sheaves in unison.

6. The fairlead mechanism according to claim 1 wherein said first guide sheaves each have a first rotational axis, said first rotational axes being positioned in spaced parallel relation on opposite sides of said second vertical plane, and said second guide sheaves each have a second rotational axis, said second rotational axes being positioned in spaced parallel relation on opposite sides of said first plane.

7. The fairlead mechanism according to claim 6 further comprising vertical sweep rope guides mounted on said subframe in spaced parallel relation on opposite sides of said second vertical plane.

8. A fairlead mechanism for guiding reciprocating travel of a rope connected to a working tool of an excavating machine such as a dragline, said fairlead mechanism comprising a support having a main frame and a subframe mounted on said main frame for oscillatory movement about a generally vertical pivot axis, a pair of first guide sheaves each having a first annular groove, said first sheaves being rotatably mounted on said support to present said first grooves in facing relation to define between said sheaves a first guide path portion through which the rope passes in frictional contact with at least one of said first guide sheaves to cause said one first guide sheave to stop-start cycle between rotating and nonrotating modes as the rope reciprocates, a first synchronizing mechanism for causing said first pair of guide sheaves to counterrotate in unison in response to frictional contact of the rope with either one of said pair of first sheaves to minimize scrubbing between the rope and the first guide sheaves, a pair of second guide sheaves each having a second annular groove, said second guide sheaves being rotatably mounted on said support to present said second grooves in spaced facing relation to define between said second sheaves a second guide path portion spaced from said first guide path portion and through which said rope also passes in frictional contact with at least one of said second guide sheaves to cause said one second guide sheave to stop-start cycle between nonrotating and rotating modes, and a second synchronizing mechanism for causing said pair of second guide sheaves to counterrotate in unison in response to frictional contact of the rope with either one of said second guide sheaves to minimize scrubbing between the rope and said second guide sheaves.

9. The fairlead mechanism according to claim 8 wherein each of said synchronizing mechanisms comprises a gear mechanism interconnecting said pair of guide sheaves to cause said pair of guide sheave to counterrotate in unison in response to rotation of either one of said guide sheaves.

10. The fairlead mechanism according to claim 9 wherein said gear mechanism comprises a cog wheel on each of said guide sheaves, said cog wheels being in mesh with each other to counterrotate said guide sheaves in unison.

11. The fairlead mechanism according to claim 8 wherein each of said synchronizing mechanisms comprises a belt drive mechanism interconnecting said pair of guide sheaves to cause said pair of guide sheaves to counterrotate in unison in response to rotation of any one of said guide sheaves.

12. The fairlead mechanism according to claim 11 wherein said belt drive mechanism comprises a pulley on each of said guide sheaves and a flexible drive element reeved around said pulleys to counterrotate said guide sheaves in unison.

13. An excavating machine such as a dragline, said machine comprising:

a chassis;

a boom mounted on said chassis for raising, lowering, and side-to-side movements;

a working tool mounted on said boom for movement relative to said chassis;

a rope actuating mechanism mounted on said chassis and including a rotatable drum, a prime mover operatively connected to rotate said drum, and a rope connected between said drum and said working tool for reciprocating travel toward and away from said chassis during movement of said working tool; and a fairlead mechanism for guiding said rope during said reciprocating travel, said fairlead mechanism including a support on said chassis, said support including a main frame and a subframe mounted on said main frame for oscillatory movement about a generally vertical pivot axis, a guide mechanism including a pair of first guide sheaves rotatably mounted on said main frame and lying in a first generally horizontal plane, and a pair of second guide sheaves rotatably mounted on said subframe and lying in a second generally vertical plane, said guide sheaves each having an annular groove, said guide sheaves of each of said pairs being mounted on said support to present said grooves in facing relation to define between said sheaves of each of said pairs a guide path portion through which said rope passes in frictional contact with at least one of said guide sheaves of each of said pairs to cause said one guide sheave of each of said pairs to stop-start cycle between rotating and nonrotating modes as said rope reciprocates, a first synchronizing mechanism for causing said pair of first guide sheaves to simultaneously stop or counterrotate in unison in response to rope contact with either one of said first guide sheaves to minimize wear induced by scrubbing between the rope and said first guide sheaves, and a second synchronizing mechanism for causing said pair of second guide sheaves to simultaneously stop or counterrotate in unison in response to rope contact with either one of said second guide sheaves to minimize wear induced by scrubbing between said rope and said second guide sheaves.

14. The machine according to claim 13 wherein at least one of said synchronizing mechanisms comprises a gear mechanism interconnecting said pair of guide sheaves to cause said pair of guide sheaves to counterrotate in unison in response to rotation of either one of said guide sheaves.

15. The machine according to claim 14 wherein said gear mechanism comprises a cog wheel on each of said guide sheaves, said cog wheels being in mesh with each other to counterrotate said guide sheaves in unison.

16. The machine according to claim 13 wherein said synchronizing mechanism comprises a belt drive mechanism interconnecting said pair of guide sheaves to cause said pair of guide sheaves to counterrotate in unison in response to rotation of either of said guide sheaves.

17. The machine according to claim 16 wherein said belt drive mechanism comprises a pulley on each of said guide sheaves and a flexible drive element reeved around said pulleys to counterrotate said guide sheaves in unison.

18. The fairlead mechanism according to claim 13 wherein said first guide sheaves each have a first rotational axis, said first rotational axis being positioned in spaced parallel relation on opposite sides of said second vertical plane, and said second guide sheaves each have a second rotational axis, said second rotational axes being positioned in spaced parallel relation on opposite sides of said first plane.

* * * * *